US006163981A

United States Patent [19]

Nilsson

[11] Patent Number: 6,163,981

[45] Date of Patent: Dec. 26, 2000

[54] METHOD AND APPARATUS FOR DRYING WOOD PARTICLES

[76] Inventor: Bengt Nilsson, 2849 Lenox Rd., #8 Vale, Atlanta, Ga. 30324

[21] Appl. No.: 09/200,494

[22] Filed: Nov. 25, 1998

[51] Int. Cl.[7] ..... F26B 7/00

[52] U.S. Cl. ..... 34/381; 34/385; 34/90; 34/207; 34/236

[58] Field of Search ..... 34/71, 90, 201, 34/203, 207, 236, 306, 381, 385, 387, 422, 444

[56] References Cited

U.S. PATENT DOCUMENTS

| | | | |
|---|---|---|---|
| 2,412,763 | 12/1946 | Baker . | |
| 4,165,216 | 8/1979 | White et al. | 432/102 |
| 4,280,415 | 7/1981 | Wirguin et al. | 110/224 |
| 4,652,278 | 3/1987 | Oliker | 55/20 |
| 4,753,020 | 6/1988 | Brunner | 34/196 |
| 4,888,885 | 12/1989 | Caughey | 34/33 |
| 4,949,474 | 8/1990 | Berg . | |
| 5,107,602 | 4/1992 | Lööf | 34/1 |
| 5,263,266 | 11/1993 | Schmidt | 34/32 |
| 5,279,046 | 1/1994 | Vincent | 34/35 |
| 5,305,891 | 4/1994 | Bielagus | 209/396 |
| 5,341,580 | 8/1994 | Teal | 34/446 |
| 5,368,168 | 11/1994 | Marrs et al. | 209/396 |
| 5,517,767 | 5/1996 | Schechinger et al. | 34/174 |
| 5,524,361 | 6/1996 | Dexter et al. | 34/502 |
| 5,557,858 | 9/1996 | Macaluso et al. | 34/273 |
| 5,697,167 | 12/1997 | Kunz et al. | 34/86 |
| 5,749,160 | 5/1998 | Dexter et al. | 34/502 |
| 5,792,319 | 8/1998 | Bennett | 162/216 |

FOREIGN PATENT DOCUMENTS

| | | |
|---|---|---|
| 0 451 659 A1 | 10/1991 | European Pat. Off. . |
| 856296 | 12/1960 | United Kingdom . |
| 2057383A | 4/1981 | United Kingdom . |

OTHER PUBLICATIONS

The Kahl Group; Brochure: Process technology for the compound feed industry, food and nutrient production, and the cereals processing sector.

Swiss Combi: ecoDry: see the difference.

Swiss Combi: News: Kuvo Filter–Trockner; May, 1995 (English translation attached).

George Koch Sons; Strand Dryer.

Swiss Combi: News: ecoDry; Mar., 1994 (English translation attached).

Mekantransport: Rockhammars Bruk do away with oil for their boilers.

*Primary Examiner*—Denise L. Ferensic
*Assistant Examiner*—Malik N. Drake
*Attorney, Agent, or Firm*—Needle & Rosenberg, P.C.

[57] ABSTRACT

A method and apparatus for drying material, especially wood particles, having moisture therein, comprising depositing the material to a selected depth onto a transport conveyor at the first end of a drying chamber. Heat is applied to the material as it is transported toward the opposite second end of the drying chamber so that, adjacent the second end, the material forms essentially two layers, a first layer having a first level of moisture therein and a second layer having a second level of moisture therein which is different from the moisture content of the first layer. Means are provided adjacent the second end for removing the second layer, which has the desired moisture, from the conveyor and directing that layer exteriorly of the chamber. The first layer, which has a remaining moisture content greater than the first layer, may be further dried to achieve the desired moisture content.

11 Claims, 7 Drawing Sheets

METHOD AND APPARATUS FOR DRYING WOOD PARTICLES

FIELD OF THE INVENTION

The invention generally relates to a method and apparatus for removing moisture from particulate material and, more particularly, to a method and apparatus for drying wood particles, such as wood chips, bark, sawdust, or shavings.

BACKGROUND OF THE INVENTION

Devices and methods directed to reducing the moisture content of particulates, e.g. cellulosic material such as wood particles, are utilized in a variety of industries and applications. When wood particles are produced from recently felled trees, the particles contain between 40% and 60% water content. Some industrial processes require wood particles of a far lower moisture content for efficient processing. For example, composition boards, such as particle board, chipboard, and medium density fiberboard (MDF), are extensively used in the construction and furniture industries due to their lower cost and favorable performance in comparison to boards composed of solid wood. However, optimal production of such boards requires wood particles having a significantly reduced moisture content, typically 2% to 10%. As another example, burning of wood particles is a useful means of disposal of waste products from forest industrial processes, such as paper production and sawmills, in a way that extracts and recovers energy. A further example most pertinent to the instant invention is the use of wood particles as an alternative fuel to generate heat and electricity. Particles with a lower moisture content, typically on the order of less than 20%, may be processed more efficiently than "green" particles, as less combustion energy is lost in driving off the entrained moisture.

Prior art devices and methods have addressed the need for drying cellulosic particulate matter, as discussed above, and other divided or particulate materials, such as grains, feed, and food products for human consumption, as well as for dehydration of crystals in the chemical industry. Prior art dryers generally fall into the categories of tumbling convection dryers and convection bed dryers. Tumbling dryers provide for the introduction of wood particles and a drying gas into a drum, wherein the particles are agitated and/or fluidized within the drying gas. When the particles are sufficiently dry for use, they are removed from the drum and separated from the drying gas.

Continuous convection dryers, such as bed dryers, operate by transporting a bed of particles through a convection chamber using conveyors, vibratory decks, paddles, or air jets, while heat is applied to the particles. Some prior art systems provide for agitation and redistribution of particles to increase exposure to the drying means and facilitate uniform drying among the particles. Certain of those embodiments utilize a separate agitating means, but in others the particles are automatically agitated through the action of the transporting means, e.g., devices incorporating vibratory decks, air jets, or multiple vertically aligned conveyors connected by material chutes.

The present technology particular to particle drying has not adequately addressed the needs of some applications requiring dried wood particles or other combustible materials as an alternative energy source to fossil fuels or nuclear fission for power generation. Particularly, present technology is insufficient to satisfy dry fuel requirements of stations requiring large quantities fuel dried with low temperature drying gases. As an example, biomass fueled large-scale sub-stoichiometric, gasification, and pyrolysis systems are currently being developed in many countries for both heat and electricity generation. In the United Kingdom in particular, the market for such developments is dominated by the Non Fossil Fuel Obligation, which has diminished income expectations of fossil fuel powered plants.

Pyrolysis processes demand a continuous supply of dried wood particles in the range of 15% to 20% moisture content. It is anticipated that continuous drying systems will be required to provide as much as 15 to 30 tons of dried wood particles per hour to fuel a single power station. Of critical importance to maximizing the efficiency of electrical generating systems is the availability of fuel feed stock of a consistent quality and moisture level.

The use of low grade heat in wood particle drying systems, generally on the order of 100° C. or less, is effective in maximizing efficiency of such systems and keeping atmospheric emissions to an acceptable level. The most cost effective way of providing this energy is by harnessing waste heat streams from the power plant, either from the exhausts of turbines or engines or from the air cooled condensers on a steam topping cycle. These streams are necessarily of a low grade as most of the useful energy has been used in the process of generating electricity.

Prior art dryers, both of the bed dryer and tumbling dryer variety, have disadvantages which render them inappropriate for use with many power generation systems. Many prior art dryers, particularly the tumbling dryer variety, require the introduction of high-temperature drying gas, typically in the range of 200° to 350° C. Waste heat streams from the power plant do not reach this temperature, and providing additional heat to the gas would substantially increase operating costs. Dryers which operate at these high temperatures are known to cause the release of environmentally unfriendly gases from wood particles and other cellulosic materials. Further, use of such high-temperature gas may cause partial combustion of the wood particles, in turn reducing the energy which may be extracted from the particles in the pyrolysis process;.

Operation of a conventional continuous bed dryer at temperatures in the range obtainable by waste heat would also produce unacceptable results. The increase in drying time necessitated by the low drying gas temperature would call for a prohibitively large drying chamber to maintain the high dry particle output rate required in many power generation systems. Alternatively, an attempt to increase flow rate of the drying gas to increase dry particle output rate would require a prohibitively large fan or blower unit, and would result in uneven drying, with over-drying of some particles in the material bed and insufficient drying of others. Further, an increase in drying gas flow rate could have the detrimental effect of causing particulate entrainment in the drying gas, which may be unacceptable by air quality standards.

Thus, a substantial but unsatisfied need exists for a method and apparatus for drying wood particles using low grade heat.

SUMMARY OF THE INVENTION

The problems of the prior art are overcome by the present method and apparatus, which provide a distinct advance in the state of the art. The low temperature bed dryer of the present invention is capable of accomplishing the drying requirements of power stations fueled by wood products by utilizing waste energy from the power generation process, while minimizing overall size and system requirements of the drying apparatus.

The apparatus broadly comprises a drying chamber generally enclosing a transporting means for conveying a selected depth of material along a material flow path in a first direction from the input end to the output end of the transporting means. The dryer also includes means for supplying a flow of heated air to the material for removing moisture therein, and a removing means disposed near the output end of the transporting means which directs a selected layer of material along a direction that may be different from the first direction, thereby separating the material. The two layers of materials thus separated may then be directed to different uses. Typically, the layer of material contacted by the removing means will be directed to a next drying chamber for further drying, and the other layer, having reached the desired moisture content, will also be discharged from the apparatus, usually to a collection or storage means.

Utilization of the removing means offers distinct advantages over prior art continuous bed dryers discussed above. When convection means are used to direct heated gas through a bed of material, a moisture gradient is formed within the material bed, such that material closest the gas input reaches the desired moisture content more quickly than material near the gas output. Many conventional continuous bed dryers destroy this moisture gradient by agitating the material, in an effort to obtain uniform drying of the entire depth of material within the bed. The present invention preserves, to some degree, a moisture gradient, and separates the material bed into a first layer which is suitably dry to be commercially useful, a second layer which has not reached the desired moisture content. If uniform moisture content among all material layers is desired, the second layer may then be directed to a second transporting means and the process repeated, until the entire quantity of material reaches the desired moisture content. Utilization of a removing means prevents over-drying of material that can occur in prior art continuous bed dryers. Additionally, in bed dryers utilizing a plurality of vertically layered drying chambers through which material is channeled, periodic removal of dry material at the end of each chamber will enable reduction of the overall height of the dryer, as less material need be housed in each successive drying chamber.

The invention may be utilized with many drying systems, including conventional continuous bed dryers. In one representative drying system, the transporting means comprises an apertured, continuous transport conveyor having an upper flight and a lower flight, the material or particle bed lying upon the upper flight. The heat applying means includes a circulation fan operably connected to a circulation duct assembly which comprises an inlet circulation duct in communication with a lower plenum below the upper flight of the transport conveyor, wherein gas is directed through the upper flight, through the material bed, and into an upper plenum above the material bed as the material is transported along its path. An outlet circulation duct through which drying gas is removed is in communication with the upper plenum. As the material is transported through the drying chamber, a moisture gradient is produced within the material bed wherein the material in contact with and adjacent to the upper flight of the transporting means contains the least moisture, and the material nearer the upper plenum contains more moisture.

When utilized in such a drying system, the removing means is located adjacent the outlet of the drying chamber, and is disposed transversely of the path of the material. As used in this specification and in the claims, the term "transverse" should be understood to mean a direction which not parallel to the referenced direction. The removing means preferably contacts the material bed at a depth corresponding to the location along the moisture gradient which defines the boundary between material of acceptable moisture content and unacceptable moisture content.

In a preferred or first embodiment, the removing means comprises a screw conveyor disposed near the outlet end of the transporting means with its axis substantially perpendicular to the direction of material flow. In this embodiment, the transporting means delivers the bed of material into contact with the screw conveyor, and the position of the screw conveyor relative to the surface of the transporting means determines the amount of material diverted.

In other embodiments, the removing means comprises a scraper conveyor (the second embodiment), a shear plate (the third embodiment), or a dam (the fourth embodiment) similarly located near the outlet end of the transporting means at a selected height over the surface of the transporting means.

It may be advantageous in certain embodiments of the invention to provide the user with control over the quantity of material diverted by the removing means. Thus, the invention provides an optional means for adjusting the location of the removing means with respect to the material bed. In one embodiment, the removing means is mounted within a plate which is rotably connected to the frame of the drying chamber about a pin. One skilled in the art will appreciate that multiple equivalent adjusting means exist, such as the mechanically or pneumatically driven motion of a removing means within a channel in a direction transverse of the direction of material flow.

DETAILED DESCRIPTION OF THE INVENTION

The invention provides a method and apparatus for drying particulate material in preparation for further processing, as described in further detail below. The particulate material may include combustible cellulosic materials such as wood chips, bark, sawdust, or shavings, as well as grain or other bulk materials which require drying.

As stated above, as used in this specification and in the claims, the term "transverse" should be understood to mean a direction which not parallel to the referenced direction.

Figure 1:
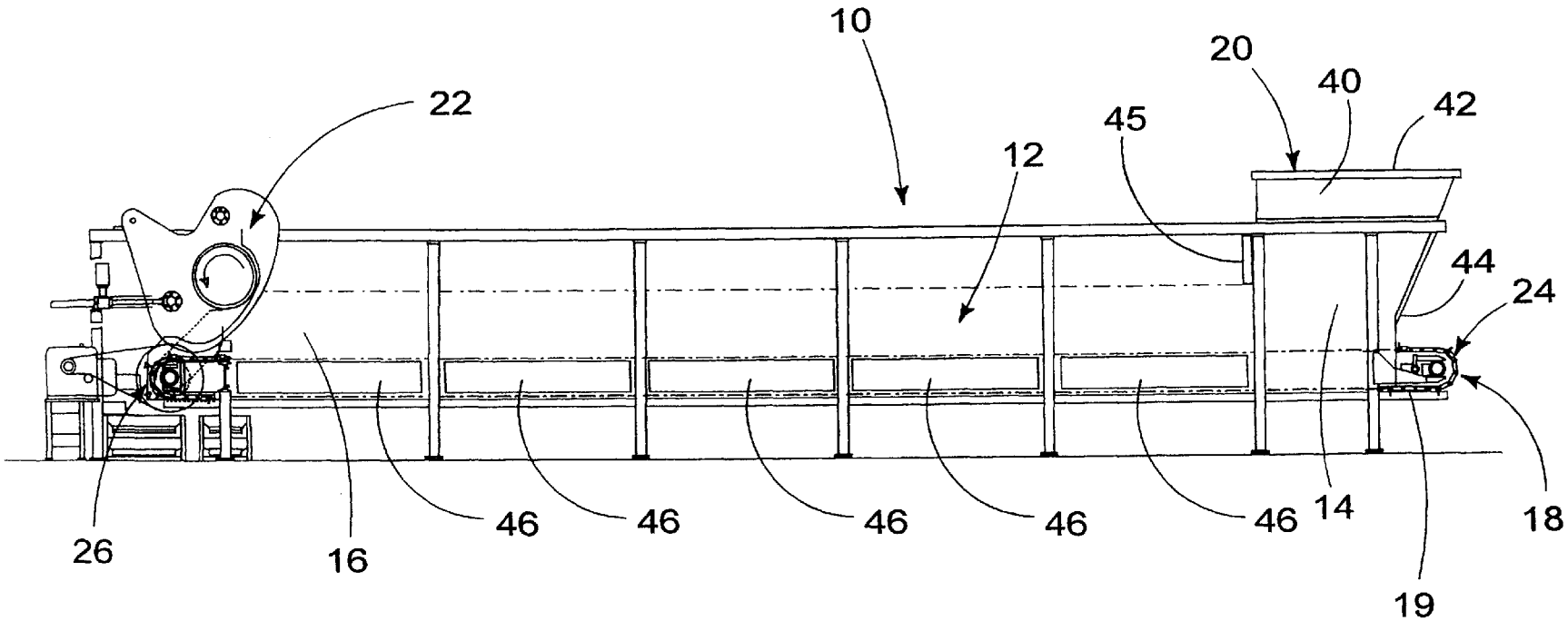
FIG. 1 is a schematic side view of the apparatus, constructed in accordance with the preferred embodiment of the present invention, illustrating the preferred orientation of the removing means with the transporting means.

Referring to the drawings, FIG. 1 shows the dryer 10 in accordance with a first embodiment. The dryer 10 comprises a drying chamber 12 having a first end 14 and an opposite second end 16, a means 18 within the drying chamber 12 for transporting the material through the chamber 12 from the first end 14 to the second end 16 along a first direction, means 20 adjacent the first end 14 of the chamber 12 for delivering the material to the transporting means 18, a means (not shown) for applying heat to the material as it traverses the chamber 12, and a means 22 for removing material, adjacent the second end 16 of the chamber 12, to a selected depth. The heat applying means may be located within or exteriorly of the chamber 12.

Figure 2:
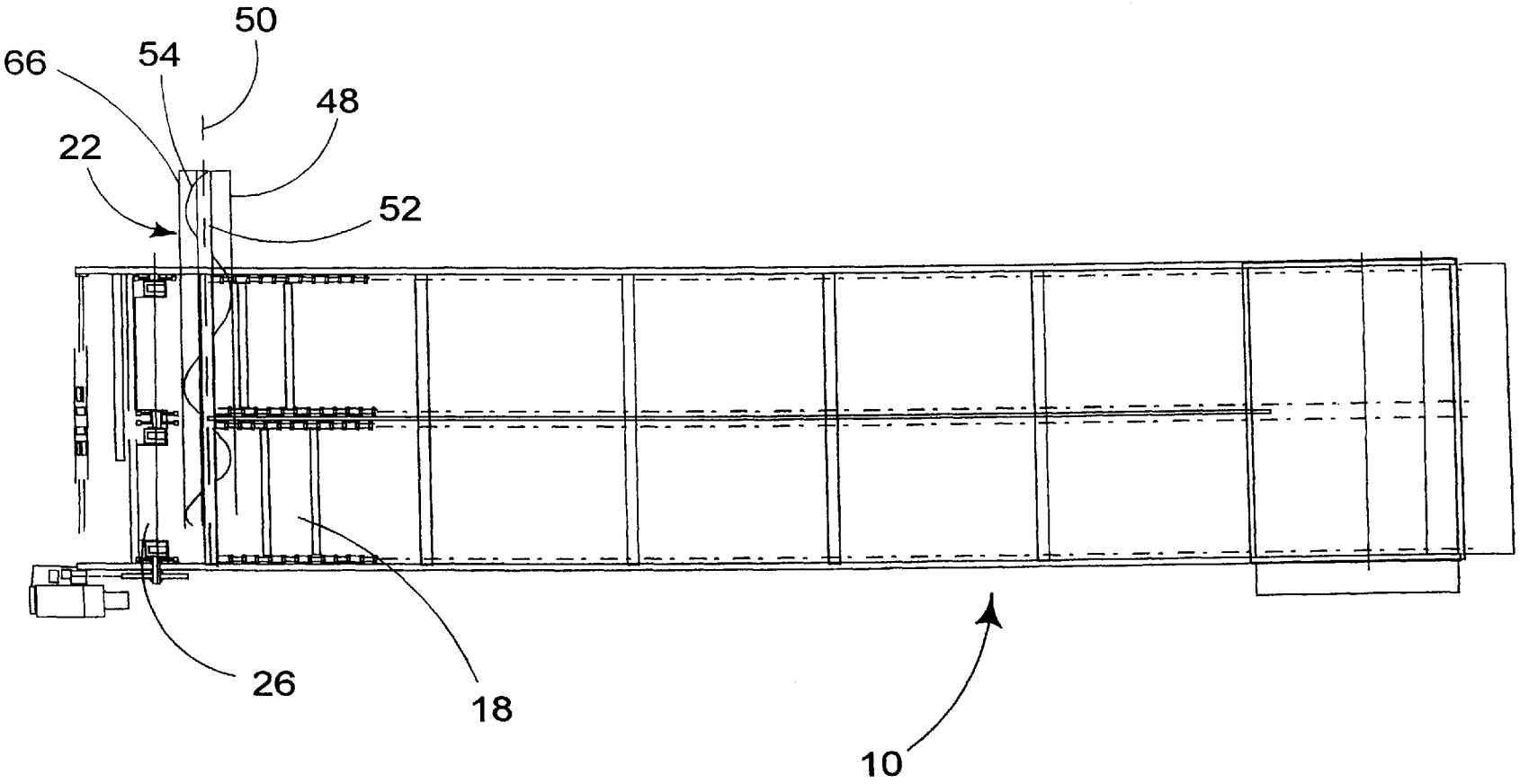
FIG. 2 is a schematic plan view of the apparatus illustrated in FIG. 1.
Figure 3:
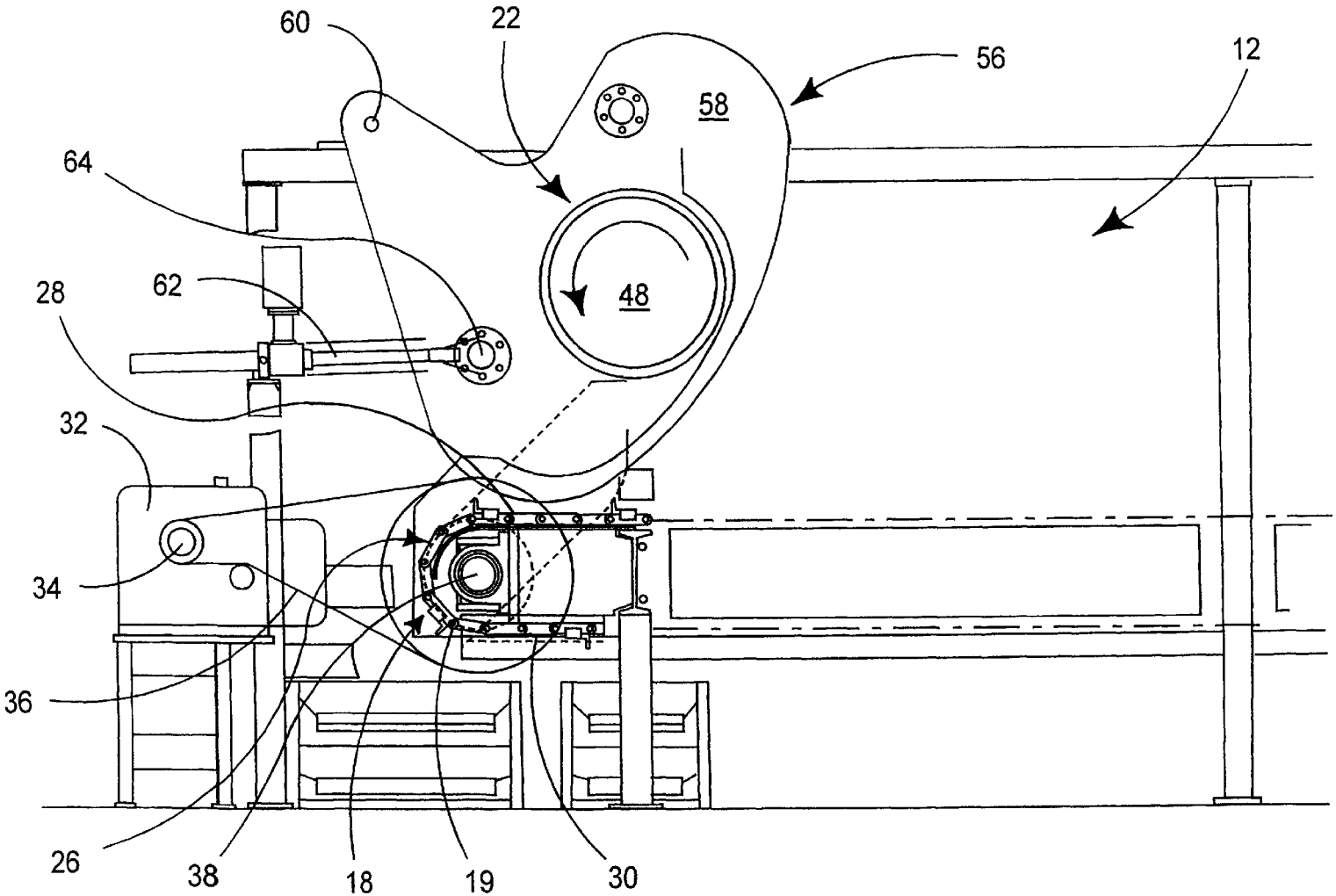
FIG. 3 is a detailed sectional schematic view of the second or output end of the apparatus in FIG. 1, illustrating the preferred embodiment of the removing means in relation to the transporting means.

In the first embodiment, as shown in FIGS. 1–3, the drying chamber 12 provides an elongated enclosure of rectangular cross section, preferably constructed of a thin walled material such as sheet metal which is impermeable to air. The chamber 12 thus provides an interior, having the first end 14 and the second end 16, through which material is conveyed longitudinally by the transporting means 18. The transporting means 18 has an input end 24, adjacent the first end 14 of the chamber 12, and being disposed below the discharge bottom of the material delivery means 20, and an opposite output end 26, adjacent the second end 16 of the chamber 12. The material is conveyed by the transporting means 18 along a first direction, from the input end 24 to the output end 26. Referring now to FIG. 3, the transporting means 18 preferably comprises a conventional endless transport conveyor 19, having an upper flight 28 and a lower flight 30. The transport conveyor 19 is preferably constructed of linked metal, but may be constructed of other material capable of withstanding operating temperatures created by the drying gases. For example, other embodiments of the transport conveyor 19 may incorporate flexible belts, chains, or other means capable of supporting the material bed and conveying the material along the first direction. Further, the transport conveyor 19 should be constructed so as to allow heat to pass therethrough, as discussed in more detail below. Movement of the transport conveyor 19 is provided by connection to a conventional drive mechanism such as a motor 32 having a drive shaft 34 linked by means of a continuous drive belt 36 to one hub 38 of the transport conveyor 19. Other arrangements for imparting motion to the transport conveyor 19 will be apparent in light of this description to one skilled in the art.

Though the transport conveyor 19 is the preferred embodiment of the transporting means 18, material movement through the drying chamber 12 may be accomplished by utilizing a variety of alternate transporting means 18. For example, alternate embodiments (not shown) which will be apparent to those skilled in the art may include a vibrating conveyor, a walking floor, or a "stoker" assembly, as those terms are known in the art. A vibrating conveyor assembly comprises a perforated rigid surface member within the chamber 12, extending substantially the length of the chamber 12, upon which the material bed is deposited. The surface member is suspended within the drying chamber 12 by a plurality of support members. Periodic back-and-forth motion of the surface member along the longitudinal axis of the drying chamber 12 is created by a conventional drive mechanism linked to the surface member. The periodic motion of the surface member results in a net motion of the material bed from the first end 14 to the second end 16 of the chamber 12.

A walking floor comprises a plurality of elongated floor members, oriented side by side within the chamber 12 with their longitudinal axes parallel to each other, each floor member having a proximate end adjacent the first end 14 of the chamber 12, an opposite distal end adjacent the second end 16 of the chamber 12, a top surface for supporting particles deposited thereon, and an opposite bottom surface. When positioned within the chamber 12, the top surfaces of the plurality of floor members together form a substantially flat surface upon which a bed of material may be deposited. Each individual floor member is linked at its proximate end to a piston-cylinder assembly capable of imparting movement to each floor member individually along its longitudinal axis. By imparting simultaneous movement to a majority of the floor members in a direction from the first end 14 to the second end 16 of the chamber 12, the material bed is transported through the chamber 12 along that direction. At any given time, a minority of floor members may be retracted by the attached piston-cylinder assembly, but such retraction does not significantly alter the flow of material through the chamber 12.

A "stoker" assembly is a variation of the walking floor assembly described above, wherein each floor member further comprises a plurality of spaced apart push bars of a wedge shaped cross section. The wedge shaped push bars provide assistance in moving the material in the direction from the first end 14 to the second end 16 of the chamber 12, while allowing retraction of the floor members with a minimum of disturbance of the material bed. Other embodiments of the transporting means 18 will be apparent to those skilled in the art.

Referring again to FIG. 1, the delivering means 20 preferably comprises a material hopper 40 provided above the first end 14 of the drying chamber 12. The hopper 40 is capable of receiving particulate material through an opening 42 at its top and directing the material through its discharge bottom end 44 and onto the input end 24 of the transporting means 18. One skilled in the art will appreciate that the delivering means 20 may be constructed in multiple ways, depending on the manner in which material is introduced to the drying chamber 12. The preferred hopper embodiment described herein is suitable for applications in which material is manually or mechanically supplied to the drying chamber 12. An optional plate 45 adjacent the first end 14 of the chamber 12 may be utilized to control the depth of material transported through the chamber 12. By providing means (not shown) for adjusting the position of the plate 45 relative to the transporting means 18, the depth of material transported through the chamber 12 may be controlled. Other embodiments of the delivering means 20 may include material hoppers of varying configurations, as well as automated systems utilizing mechanically or pneumatically driven material conveyors.

A heat applying means (not shown) is provided for exposing the material to heated drying gases as the material is moved through the chamber 12. In one embodiment, the heat applying means comprises a gas flow control system, wherein heated gas is applied to the material bed such that gas flow through the entire depth of the bed is achieved, thereby driving moisture from the material. In this embodiment, the gas flow control system is utilized for introducing a flow of heated gas to the bottom of the material bed through the upper flight 28 of the transport conveyor 19. In such an embodiment, as illustrated in FIG. 1, the gas flow control system includes a circulation fan (not shown) in communication with a lower plenum 46 below the upper flight 28 of the transport conveyor 19, the top of the lower plenum 46 either being open to the upper flight of the transport conveyor 19 or perforated. The lower plenum 46 is preferably a chamber underlying substantially the entire upper flight 28 of the transport conveyor 19. The transporting means 18 is preferably perforated, such that the heated gas may be directed through the upper flight 28, through the material bed, and into an optional upper plenum (not shown) above the material bed. The cooled and humidified gas is then directed from the upper plenum through an outlet circulation duct (not shown) in communication with the upper plenum and the exterior of the drying chamber 12 so that the gas is discharged from the drying chamber 12. Alternatively, in an embodiment of the invention wherein the drying chamber 12 is open to the atmosphere above the material bed, the cooled and humidified gas may be passed from the material bed directly into the atmosphere without the use of an upper plenum or outlet circulation duct. Other heat applying means will be apparent to one skilled in the art based upon this description.

By application of the heated gas to the material bed, moisture is driven from the material such that a moisture gradient exists within the material bed. For example, in an embodiment utilizing a bottom-to-top flow of drying gases as described above, material nearer the bottom of the material bed will have a lower moisture content than material directly above. As a simplification, however, we will refer to the material bed as being defined in two layers, one containing material with an average moisture content of one level, which is different from the average moisture content of the other layer. Thus, at least by the time the material is adjacent the second end 16 of the chamber 12, the material forms essentially two layers, a first layer of material having a first level of moisture therein, and a second layer of material having a second level of moisture therein which is different from the moisture content of the first layer. The bottom of the first layer of material engages the upper flight 28 of the transport conveyor 19 and the bottom of the second layer of material engages the top of the first layer. In the preferred embodiment, wherein the heat applying means provides a flow of heated gas in a bottom-to-top direction through the material bed, the second level of moisture is greater than the first level of moisture.

It will be apparent to one skilled in the art, however, that embodiments employing alternately configured heat applying means may be utilized. One such embodiment is a system in which gas flow is inverted, wherein heated gas is introduced into an upper plenum as described above, and directed through the material bed from the top to the bottom of the bed, through the transport conveyor 19, and discharged through a duct (not shown) in communication with a lower plenum (not shown). As will be apparent to one skilled in the art, such an embodiment produces a material bed wherein, adjacent the second end 16 of the drying chamber 12, the first level of moisture is greater than the second level of moisture.

Adjacent the second end 16 of the drying chamber 12, the removing means 22 is positioned above the upper flight 28 and in the path of the material, such that a portion of the material bed contacts the removing means 22. Referring now to FIG. 2, in the preferred embodiment, the removing means 22 comprises a screw conveyor 48 positioned directly above the outlet end 26 of the transporting means 18, with its longitudinal axis 50 transverse of the first direction. The screw conveyor 48 may be of an ordinary construction, whereby rotation of the screw 52 directs material in contact with its blades 54 along a path substantially parallel to the longitudinal axis 50. Means (discussed hereinafter) are provided to dispose the screw conveyor 48 at any selected height above the upper flight 28 so that as the second layer of material contacts the screw conveyor 48, a desired amount of the material is directed along the longitudinal axis 50, thereby separating the second layer from the first layer.

Figure 4:
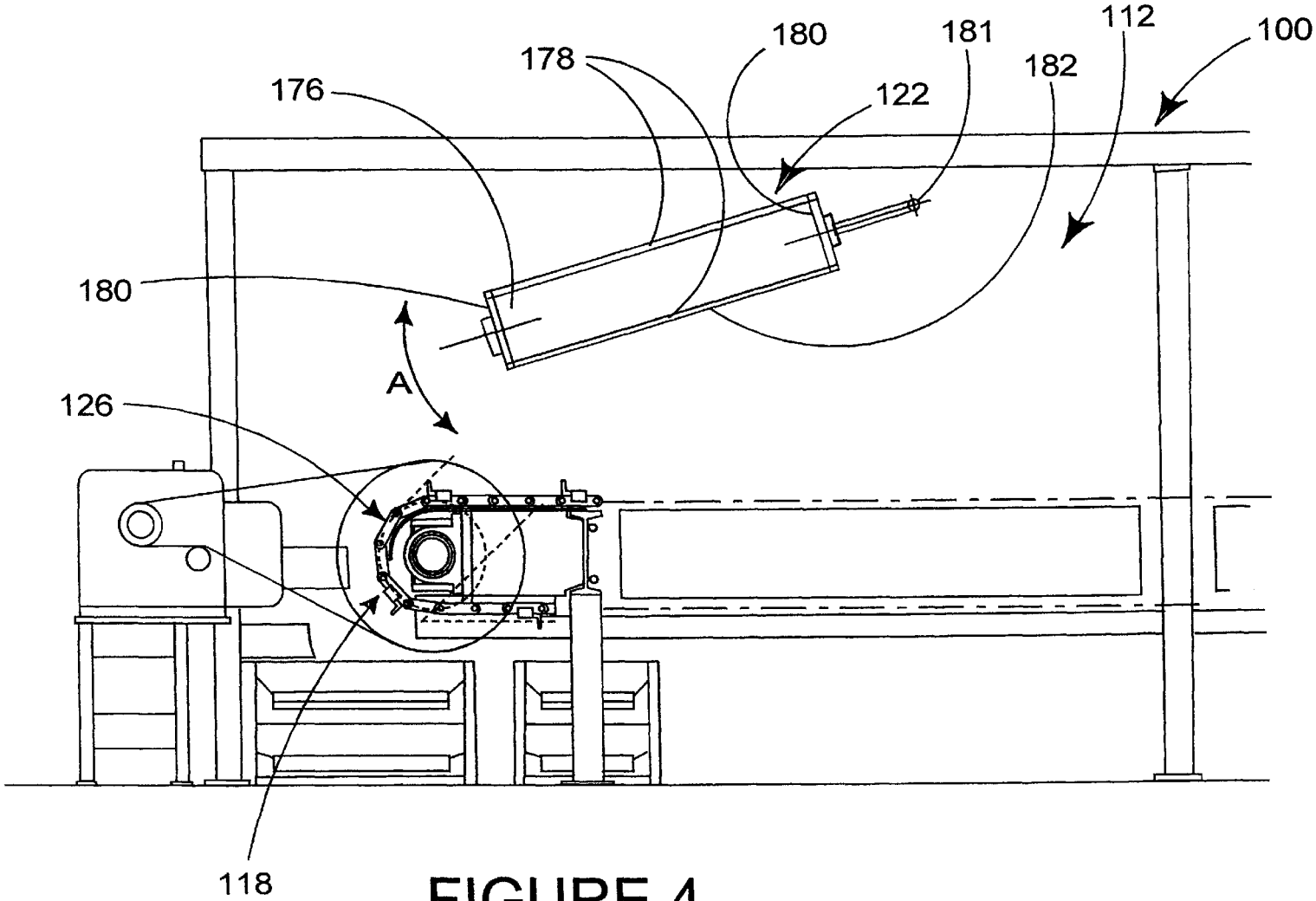
FIG. 4 is a sectional schematic view of the apparatus, illustrating the second embodiment of the removing means, comprising a scraper conveyor, in relation to the transporting means.

Other embodiments of the removing means 22 will be apparent to one skilled in the art. For example, referring to FIG. 4, in an alternate or second embodiment 100 of the present invention, a scraper conveyor 176 serves as removing means 122. The scraper conveyor 176 is utilized to remove one layer of material within the drying chamber 112 and direct the removed material in a second direction. In such an embodiment, a conventional endless textured belt 178, constructed of linked metal or other flexible material is positioned in the path of one layer of material adjacent the outlet end 126 of the transporting means 118. The scraper conveyor 176 may be tensioned around opposite sprockets or hubs 180 which may be connected to a drive mechanism (not shown) to maintain continuous motion of the scraper conveyor 176. When one flight 182 of the scraper conveyor 176 is placed in the path of a selected layer of the material, the contacted material is directed along the path of the scraper conveyor 176, thereby separating the contacted layer from the other layer of material.

Figure 5:
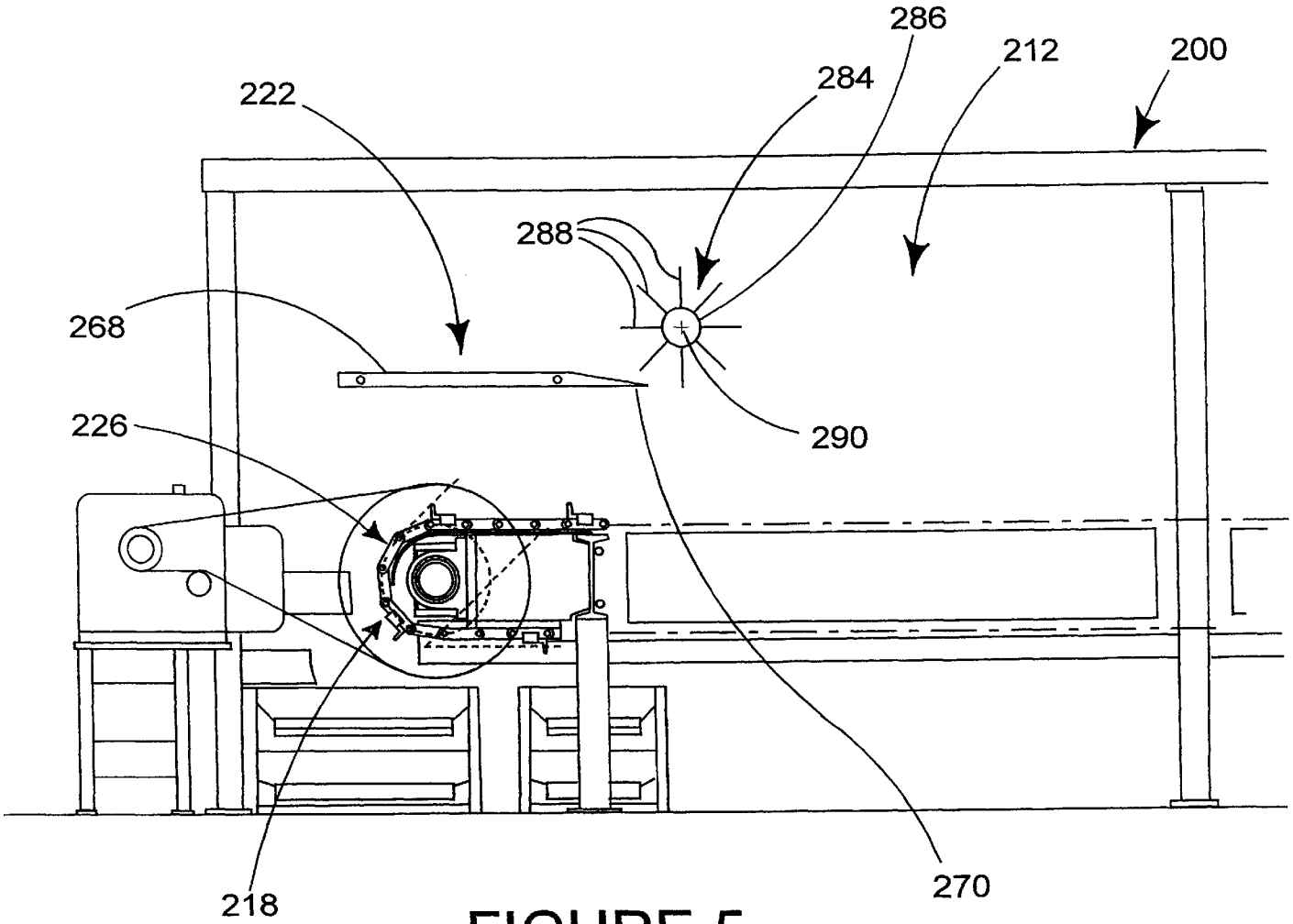
FIG. 5 is a sectional schematic view of the apparatus, illustrating the third embodiment of the removing means, comprising a shear plate and optional milling rotor, in relation to the transporting means.

Referring to FIG. 5, a third embodiment 200 of the present invention, the removing means 222 comprises a shear plate 268 horizontally disposed within the chamber 212 above the outlet end 226 of the transporting means 218. The plate 268 is positioned such that the beveled leading edge 270 of the plate 268 contacts the material bed at the junction of the first layer and the second layer, thereby separating the layers of material. By the operation of the shear plate 268, the layers of material are separated despite the continued motion of the second layer of material generally along the first direction. Still referring to FIG. 5, an additional embodiment of the removing means 222 may include a shear plate 268 in conjunction with a milling rotor 284 disposed adjacent and slightly above the leading edge 270 of the shear plate 268, and in the path of at least one layer of material. The milling rotor 284 may be of conventional construction, comprising a central rotor 286 with a plurality of blades 288 spaced about its circumference and extending therefrom. When the milling rotor 284 is rotated about its axis 290 by a conventional drive mechanism (not shown) or other drive means known to those skilled in the art, the blades 288 aid in the movement of the contacted material over the shear plate 268, thus facilitating separation of the layers of material.

Figure 6:
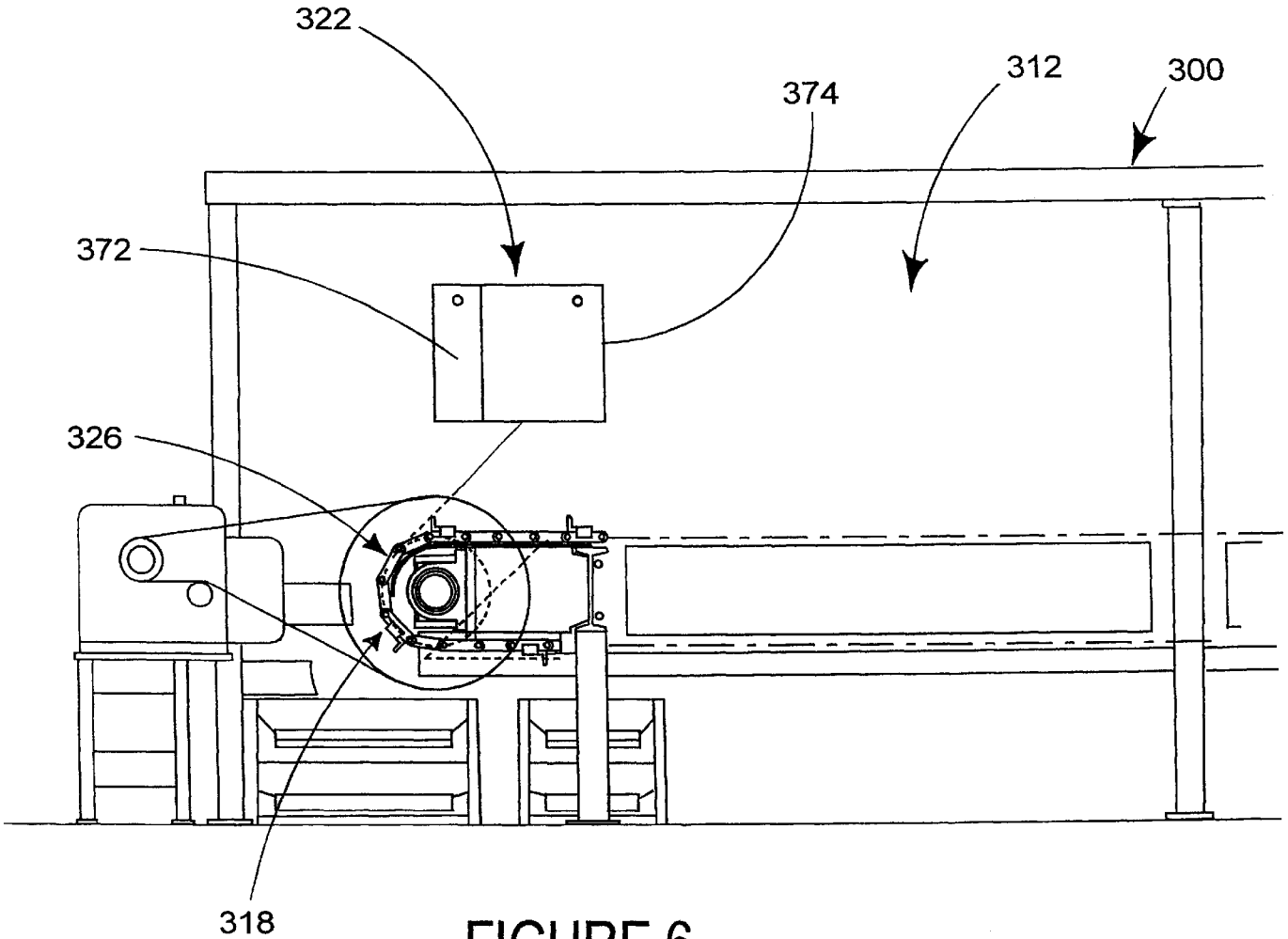
FIG. 6 is a sectional schematic view of the apparatus, illustrating the fourth embodiment of the removing means, comprising a material dam, in relation to the transporting means.
Figure 7:
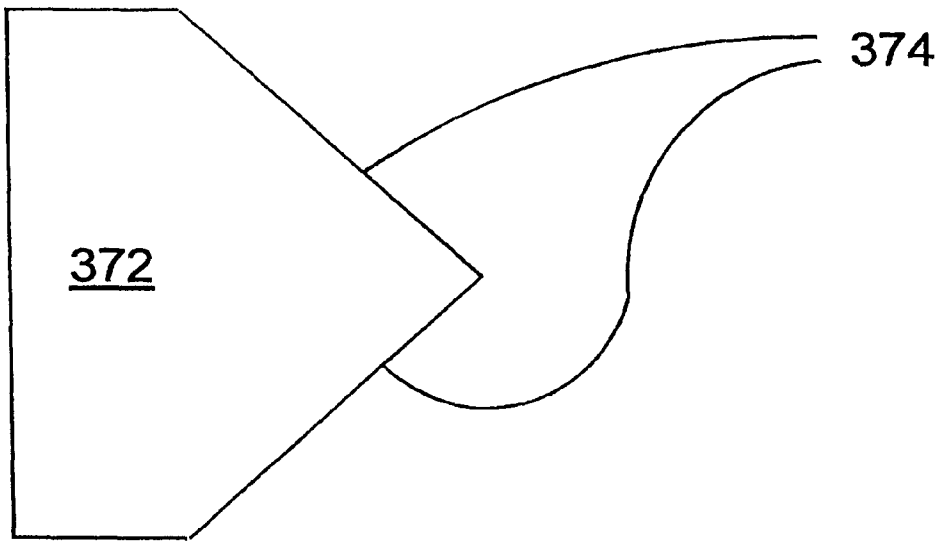
FIG. 7 is a schematic plan view of the fourth embodiment of the removing means, comprising a material dam, as illustrated in FIG. 6.

Referring to FIGS. 6 and 7, in the fourth embodiment 300 of the present invention, the removing means 322 comprises a material dam 372 positioned within the chamber 312 above the outlet end 326 of the transporting means 318. The forward vertical face 374 of the dam 372 is positioned transverse of the first direction such that the motion of one layer of material is obstructed by the face 374. The contacted layer is thereby removed from the other layer, and directed along the face 374, transverse of the first direction. One skilled in the art will realize that the orientation of the face 374 of the dam 372 with respect to the direction of material flow through the chamber 312 may be adjusted to facilitate removal of the material. FIGS. 6 and 7 display an embodiment wherein the face 374 is substantially vertical and non-perpendicular to the direction of material flow. Other configurations, including embodiments wherein the face 374 is non-vertical or substantially perpendicular to the direction of material flow may also be utilized, and will be obvious to one skilled in the art.

Referring now to FIG. 3, in any embodiment of the invention, it may be advantageous to utilize an adjusting means 56 connected to the removing means 22 to control the position of the removing means 22 relative to the transporting means 18, and thus control the amount of material removed. In a preferred embodiment, as shown most clearly in FIG. 3, the removing means 22 may be mounted within a plate 58 which is rotably connected to the frame of the drying chamber 12 about pin 60. Rotation of the plate 58 thus produces movement of the removing means 22 in an arcuate path, such that the position of the removing means 22 relative to the transporting means 18 may be controlled. Rotation of the plate 58 may be controlled by manipulating, through mechanical or pneumatic means or otherwise, an armature 62 which engages a peg 64 fixed to the plate 58.

Alternate embodiments of the adjusting means 56 will be obvious to one skilled in the art, and need only control the position of the removing means 22 relative to the transporting means 18. For example, referring particularly to the second embodiment 100 of the invention, shown in FIG. 4, the scraper conveyor 176 may be rotably connected to the frame of the drying chamber 12 about pin 181. Rotation of the scraper conveyor about pin 181 in the direction marked A in FIG. 4 will thus alter the amount of material contacted by the scraper conveyor 176.

Further, in other embodiments of the adjusting means 56, which may be implemented in any embodiment of the invention, the removing means 22 may be reciprocated along a path transverse of the first direction by mounting the removing means 22 to a cylinder and piston assembly (not shown), or by mounting the removing means 22 to a rack and pinion assembly (not shown).

Other embodiments of the invention may include further means (not shown) adjacent the outlet end 26 of the transporting means 18 for delivering removed material to a second drying chamber (not shown) for further drying. In one such embodiment, the delivering means comprises a chute which receives removed material and conveys the material to the input end of a second transporting means, within a second drying chamber, wherein further drying of the material therein takes place.

The method of the invention utilizes the above described apparatus to remove moisture from particulate material, especially combustible cellulosic materials such as wood particles, sawdust, or other materials. In a first embodiment, the method includes delivering cellulosic material having moisture therein onto the input end 24 of a transporter 18 which is disposed within a drying chamber 12. The transporter 18 is provided within the interior of the drying chamber 12, having an input end 24 adjacent the first end 14 of the drying chamber 12, and an output end 26 at the opposite second end 16 of the chamber 12. The transporter, as referred to herein, may be of a variety of embodiments, including any described in this specification as various embodiments of the transporting means.

Material is deposited onto the input end 24 of the transport conveyor 19, forming a bed of material. Preferably, the delivery of material should be maintained at a substantially constant depth to promote uniform drying throughout the depth of material. By motion of the transport conveyor 19, the material is transported from the first end 14 to the second end 16 of the drying chamber 12 along a first direction.

As the material is transported through the drying chamber 12, heated gas is applied to the material bed by a gas flow control system, such that gas flow through the entire depth of the bed is achieved, thereby driving moisture from the material. As above described, the preferred embodiment of the apparatus provides a flow of heated gas through the material from the bottom to the top of the material bed. Application of the heated gas to the material bed drives moisture from the material so that, adjacent the second end 16 of the chamber 12, the material forms essentially two layers. The first layer of material has a first level of moisture therein, and the second layer of material has a second level of moisture therein which is different from the moisture content of the first layer. The bottom of the first layer of material engages the upper flight of the transport conveyor 19 and the bottom of the second layer of material engages the top of the first layer. In the preferred embodiment, the second level of moisture is greater than the first level of moisture.

Adjacent the second end of the drying chamber 12, a selected layer of material is removed to a selected depth from the material bed and directed exteriorly of the drying chamber 12, thereby separating the first and second layers of material. As described in detail above, the removing and directing steps may be achieved by utilizing a variety of different embodiments, including but not limited to a screw conveyor 48, a scraper conveyor 176 a shear plate 268, and a material dam 372.

In the preferred embodiment, separation of the first layer from the second layer is achieved by removing and directing the second layer of material exteriorly of the chamber 12. One skilled in the art will appreciate that in other embodiments of the invention, such separation may be achieved by removing and directing the first layer of material exteriorly of the chamber 12.

Once separation of the material bed into two layers containing different levels of moisture has been achieved, further processing steps may be undertaken, but some users of the method may wish to end the process at this stage. However, in applications where a uniform level of moisture is required throughout the material, further drying of one layer of material is required. In such an embodiment, the directing step includes the step of transporting the layer of material having a the higher moisture content to a second drying chamber (not shown). A material collector (not shown) is preferably provided adjacent the removing means 22 which receives the removed material, which is then transported to the input end of a second transporting means (not shown), disposed within a second drying chamber (not shown). Within the second drying chamber, the aforementioned steps of the method are repeated. In a preferred embodiment, a series of drying chambers are oriented in parallel, side by side relation to each other. It will be appreciated by those skilled in the art that a plurality of such secondary drying chambers may alternatively be utilized according to the present method in vertical orientation, such that the material requiring further processing follows a substantially serpentine material flow path through the interior of the multiple drying chambers.

Although the present invention has been described with reference to the illustrated preferred embodiment, it is noted that variations and changes may be made, and equivalents employed without departing from the scope of the invention as set forth in the claims.

What I claim is:

1. A method of drying material, comprising the steps of:

a. delivering material having moisture therein onto the input end of a transporter which is disposed within a drying chamber having a first end adjacent to the input end of the transporter and a second end opposite the first end;

b. transporting the material from the first end to the second end, along a first direction;

c. applying heat to the material as it passes from the first end to the second end so that adjacent the second end of the chamber, the material forms essentially two layers, a first layer of material having a first level of moisture therein, and a second layer of material having a second level of moisture therein which is different from the moisture content of the first layer;

d. positioning an adjustable material removing means in the path of the material adjacent the second end of the chamber;

e. removing by the removing means a selected layer, adjacent the second end of the chamber, to a selected depth; and f. directing the selected layer exteriorly of the chamber;

wherein the selected layer is the second layer and wherein the directing step comprises diverting the second layer in a direction selected from either the first direction or a second direction which is transverse of the first direction.

2. A method of drying material, comprising the steps of:

a. delivering material having moisture therein onto the input end of a transporter which is disposed within a drying chamber having a first end adjacent to the input end of the transporter and a second end opposite the first end;

b. transporting the material from the first end to the second end, along a first direction;

c. applying heat to the material as it passes from the first end to the second end so that adjacent the second end of the chamber, the material forms essentially two layers, a first layer of material having a first level of moisture therein, and a second layer of material having a second level of moisture therein which is different from the moisture content of the first layer;

d. positioning an adjustable material removing means in the path of the material adjacent the second end of the chamber;

e. removing by the removing means a selected layer, adjacent the second end of the chamber, to a selected depth; and f. directing the selected layer exteriorly of the chamber, wherein the transporter is perforated and the applying step comprises passing heated air upwardly through the upper flight of the transporter, wherein the bottom of the first layer of material engages the upper flight and the bottom of the second layer engages the top of the first layer, and wherein the removing step comprises the second layer contacting the infeed of a screw conveyor which is transversely disposed within the chamber above the first layer adjacent the second layer.

3. An apparatus for removing moisture from material, comprising:

a. a drying chamber having a first end and an opposite second end;

b. means for transporting the material through the chamber from the first end to the second end along a first direction;

c. means in the chamber for applying heat to the material as it traverses the chamber from the first end to the second end so that adjacent the second end, the material forms essentially two layers, a first layer having a first level of moisture therein and a second layer having a second level of moisture therein which is different from the moisture content of the first layer; and, d. means for removing material, adjacent the second end of the chamber, to a selected depth;

wherein the removing means comprises means for directing one of the layers along a direction selected from either the first direction or a second direction which is transverse to the first direction and means for adjusting the position of the directing means relative to the transporting means.

4. An apparatus as claimed in claim 3 wherein said directing means comprises a screw conveyor which is transversely disposed within the chamber above the first layer which contacts the second layer adjacent the second end.

5. An apparatus as claimed in claim 3 wherein said directing means comprises a scraper conveyor which is transversely disposed within the chamber above the first layer which contacts the second layer adjacent the second end.

6. An apparatus as claimed in claim 3 wherein said directing means comprises a shear plate horizontally disposed within the chamber above the transporting means, which contacts the material between the first layer and the second layer.

7. An apparatus as claimed in claim 3 wherein said directing means comprises a material dam which is transversely disposed within the chamber above the first layer contacting the second layer adjacent the second end.

8. An apparatus for removing moisture from material, comprising:

a. a drying chamber having a first end and an opposite second end;

b. means for transporting the material through the chamber from the first end to the second end along a first direction;

c. means adjacent the first end of the chamber for delivering the material to the transporting means;

d. means in the chamber for applying heat to the material as it traverses the chamber from the first end to the second end so that adjacent the second end, the material forms essentially two layers, a first layer having a first level of moisture therein and a second layer having a second level of moisture therein which is different from the moisture content of the first layer; and e. means for removing material, adjacent the second end of the chamber, to a selected depth;

wherein the removing means comprises means for adjusting the position of removing means relative to the transporting means, and wherein the transporting means comprises an endless, perforated transport conveyor having an upper flight upon which the material is disposed by the delivering means and wherein the bottom of the first layer of material engages the upper flight and the bottom of the second layer engages the top of the first layer.

9. An apparatus as claimed in claim 8, wherein the heat applying means comprises means for passing heated air upwardly through perforations in the upper flight.

10. An apparatus as claimed in claim 3, wherein the directing means further comprises means for adjusting the position of the directing means relative to the transporting means.

11. An apparatus as claimed in claim 3, wherein the directing means further comprises means for delivering removed material to a second drying chamber for further heating.

* * * * *